US006311405B1

(12) United States Patent
Slates

(10) Patent No.: US 6,311,405 B1
(45) **Date of Patent: *Nov. 6, 2001**

(54) FIBER OPTIC PIN SIGHT FOR A BOW

(75) Inventor: Scott O. Slates, St. Charles, MO (US)

(73) Assignee: Toxonics Manufacturing Inc., Wentzville, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/811,527

(22) Filed: Mar. 4, 1997

Related U.S. Application Data

(63) Continuation-in-part of application No. 08/494,946, filed on Jun. 26, 1995, now Pat. No. 5,619,801.

(51) Int. Cl.[7] ..... F41G 1/467

(52) U.S. Cl. ..... 33/265; 124/87; 42/132

(58) Field of Search ..... 33/241, 265; 124/87; 385/76, 77, 78, 81; 403/109.1, 109.4, 110, 374.3; 279/42, 43.2

(56) References Cited

U.S. PATENT DOCUMENTS

| | | | | |
|---|---|---|---|---|
| Re. 31,515 | | 2/1984 | Heldt | 385/87 |
| 786,166 | * | 3/1905 | Shaffner | 279/42 |
| 789,499 | * | 5/1905 | Lightholder | 403/287 |
| 802,277 | | 10/1905 | Fric | 33/241 |
| 1,024,126 | * | 4/1912 | Fletcher | 279/42 |
| 1,045,886 | * | 12/1912 | Reay | 279/42 |
| 1,931,552 | | 10/1933 | Maris | 33/241 |
| 2,155,169 | | 4/1939 | Moses | 33/561.2 |
| 2,195,526 | | 4/1940 | Traver | 362/573 |
| 2,504,115 | | 4/1950 | Dickison | 33/227 |
| 3,121,163 | | 2/1964 | Rickert | 250/467.1 |
| 3,184,851 | | 5/1965 | Simmons | 33/241 |
| 3,284,904 | | 11/1966 | Rade | 33/265 |
| 3,320,671 | | 5/1967 | Rickert et al. | 33/241 |
| 3,582,638 | | 6/1971 | Peters | 362/577 |
| 3,678,590 | | 7/1972 | Hayward | 33/241 |
| 3,914,873 | | 10/1975 | Elliott, Jr. et al. | 33/241 |
| 3,945,127 | | 3/1976 | Spencer | 33/265 |
| 4,030,203 | | 6/1977 | Ackerman, Jr. | 33/241 |
| 4,070,763 | | 1/1978 | Carts, Jr. | 33/241 |
| 4,166,324 | | 9/1979 | Carollo et al. | 33/241 |
| 4,170,071 | | 10/1979 | Mann et al. | 33/265 |
| 4,177,572 | | 12/1979 | Hindes | 33/265 |
| 4,202,644 | * | 5/1980 | Soussloff | 403/389 |
| 4,220,983 | | 9/1980 | Schroeder | 362/114 |
| 4,309,827 | | 1/1982 | Larson | 33/265 |
| 4,400,887 | | 8/1983 | Mason | 33/265 |
| 4,434,560 | | 3/1984 | Comeyne | 33/241 |
| 4,535,747 | | 8/1985 | Kudlacek | 124/87 |
| 4,603,942 | | 8/1986 | Chang et al. | 385/100 |
| 4,846,141 | | 7/1989 | Johnson | 124/87 |
| 4,928,394 | | 5/1990 | Sherman | 33/265 |
| 4,953,302 | | 9/1990 | Gould | 33/265 |
| 4,977,677 | | 12/1990 | Troescher, Jr. | 33/265 |
| 5,086,567 | | 2/1992 | Tutsch | 33/265 |
| 5,090,805 | | 2/1992 | Stawarz | 356/251 |
| 5,122,932 | | 6/1992 | Ziller | 362/551 |
| 5,148,603 | | 9/1992 | Beutler | 33/265 |
| 5,157,839 | | 10/1992 | Beutler | 33/265 |
| 5,174,269 | | 12/1992 | Sappington | 124/87 |
| 5,201,124 | | 4/1993 | Sherman | 33/265 |
| 5,231,765 | | 8/1993 | Sherman | 33/241 |
| 5,418,874 | | 5/1995 | Carlisle et al. | 385/76 |
| 5,435,068 | | 7/1995 | Thames et al. | 33/265 |
| 5,442,861 | | 8/1995 | Lorocco | 33/241 |
| 5,619,801 | | 4/1997 | Slates | 33/241 |
| 5,649,526 | * | 7/1997 | Ellig | 124/87 |
| 5,685,081 | * | 11/1997 | Winegar | 33/265 |

* cited by examiner

*Primary Examiner*—Diego Gutierrez
*Assistant Examiner*—R. Alexander Smith
(74) *Attorney, Agent, or Firm*—Paul M. Denk

(57) ABSTRACT

A fiber optic pin sight includes a fiber optic pin holder which grips the pin to secure the pin in the sight. The pin holder includes a threaded shaft having a bore through which the pin extends and a nut which is threaded about the shaft. The shaft is sloped outwardly at its back end and includes a slot which extends forwardly from the back end to define a pair of spaced apart flexible legs. When the nut is threaded over the expanded back end of the shaft, the legs are urged together to grip the pin.

8 Claims, 2 Drawing Sheets

FIBER OPTIC PIN SIGHT FOR A BOW

CROSS-REFERENCE TO RELATED APPLICATIONS

This is a continuation-in-part of Ser. No. 08/494,946 filed Jun. 26, 1995, now U.S. Pat. No. 5,619,801, and which is incorporated herein by reference.

STATEMENT REGARDING FEDERALLY SPONSORED RESEARCH OR DEVELOPMENT

Not Applicable.

BACKGROUND OF THE INVENTION

This invention relates to pin sights for bows, and in particular to a fiber optic pin sight.

Pin sights are often used with bows when hunting. As is known pin sights typically include a plurality of pins that are calibrated for certain distances, for example 15, 30, 50 and 100 yards. These pins are sighted on the target to obtain the proper trajectory for the arrow to be shot. In the past, the pins have typically been made of metal. However, some pin sights now use fiber optic pins. U.S. Pat. No. 5,231,765, for example, discloses such a sight.

Fiber optic pins or pins are generally secured in place in a pin sight using a screw or the like which compresses the fiber optic pin. When a fiber optic pin is compressed at a point, the pin can be damaged and the ability of the fiber optic pin to transmit light can thus be hindered. Obviously, if the pin is damaged and unable to transmit light efficiently, the pin sight will not be operable. On the other hand, if the pin is not securely set in the sight, it can accidentally be moved. The pins are calibrated to correspond to specific distances. If the pin is moved relative to its mount, the fiber optic pin will be out of calibration. This would be true even if the pin's mount did not move. It is therefore desirable to firmly hold the pin in place without unduly compressing the fiber optic pin.

BRIEF SUMMARY OF THE INVENTION

One object of the present invention is to provide a fiber optic pin sight.

Another object is to provide such a pin sight in which the fiber optic pin of the pin sight is securely held in place.

Another object is to provide such a bow sight which will not damage the fiber optic pin.

Another object is to provide such a pin sight in which the fiber optic pin is clamped along a portion of its length, rather than being compressed at a single point, to secure the fiber optic pin in the bow sight.

Another object is to provide such a bow sight in which the pin is easily replaced if necessary.

These and other objects will become apparent to those skilled in the art in light of the following disclosure and accompanying drawings.

In accordance with the invention, generally stated, a fiber optic pin sight is provided which is mountable to a bow. The sight includes a mounting plate which is operatively securable to the bow, a plurality of pin mounting blocks secured to the mounting plate, a fiber optic pin holder secured to each of the pin mounting blocks, and a fiber optic pin extending through and secured in the pin holder. The pin holder includes an externally threaded shaft defining a shaft bore and a compression nut defining a threaded nut bore. The pin extends through the shaft bore. The shaft has a front end and a back end, an outer diameter which is substantially constant along the length of the shaft, and a slot extending forwardly from the back end to define two spaced apart legs. The outer diameter of the shaft is slopingly reduced at the back of the shaft. The slot is sufficiently long so that said legs are slightly flexible, and can grip the pin. The nut bore has a tapered section which reduces the diameter of the nut bore from a diameter that the shaft can be threaded through to a smaller diameter. As the shaft is threaded into the nut, and as the slit portion of the shaft is introduced into the tapered section of the nut bore, the nut brings the shaft legs together such that the legs grip the said fiber optic pin. Preferable, the nut bore has three sections: a threaded section of constant diameter, the tapered section, and a third section which receives the nose of the shaft. The third section has a diameter slightly larger than the end of the shaft nose and smaller than the diameter of the main part or body of the shaft.

The shaft is preferably made of brass. To enable the legs to be sufficiently flexible, the slot a length approximately 1.6–1.8 times the outer diameter of the shaft. The nut bore preferably does not extend all the way through the nut. The sight preferably includes a generally U-shaped guard which surrounds the fiber optic pins.

In another embodiment, the shaft has an outwardly expanding or sloped back end, rather than an inwardly sloped back end. The nut bore is of generally constant diameter, and when it is threaded over the expanded back end of the shaft, the legs at the back end of the shaft are brought together to tightly grip the fiber optic pin.

DETAILED DESCRIPTION OF THE INVENTION

Figure 1:
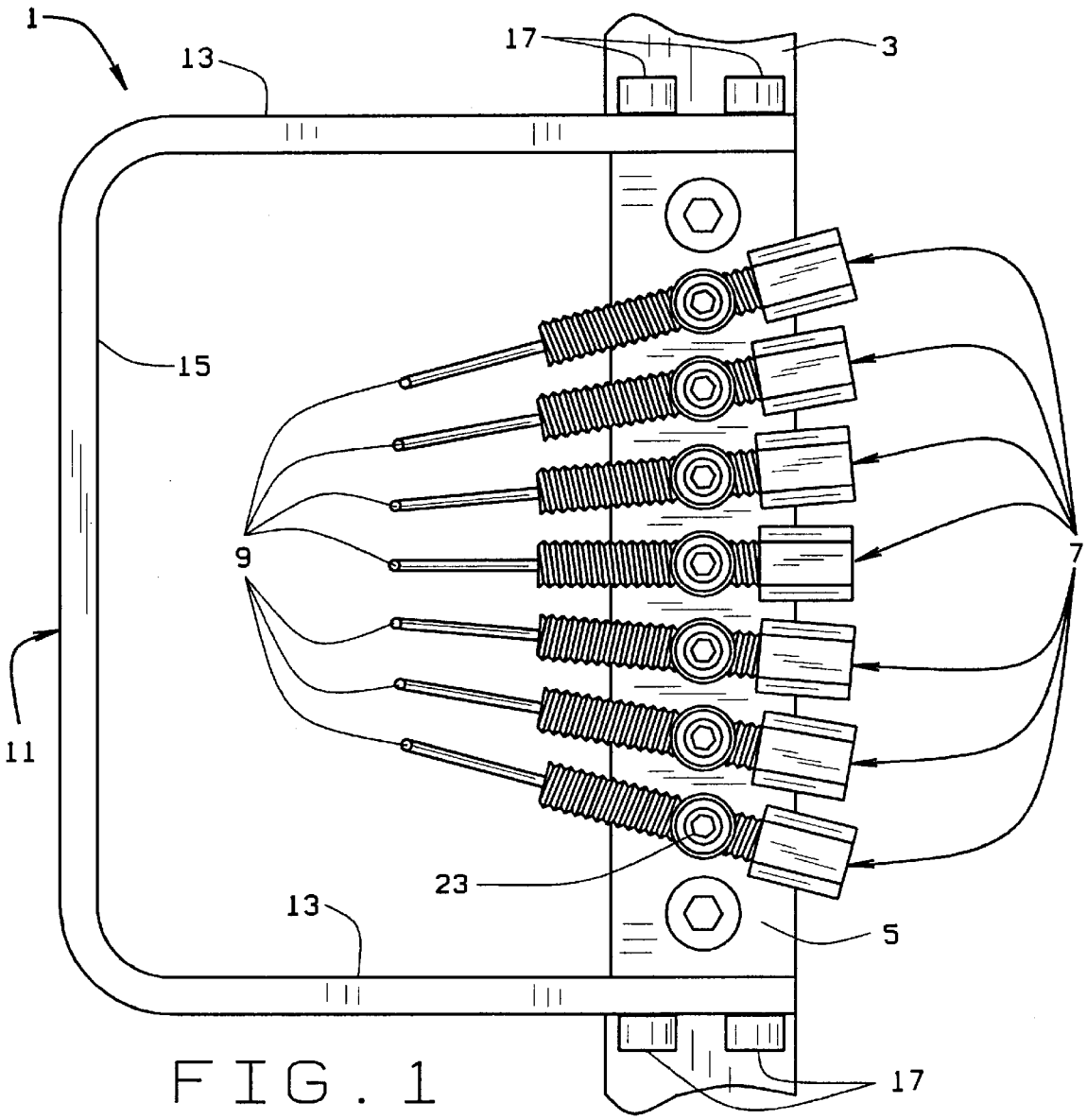
FIG. 1 is an elevational view of a pin sight of the present invention mounted on a bow.

Referring initially to FIG. 1, a sight 1 of the present invention is shown secured to a bow 3. The sight includes a mounting plate 5 which may be secured to the bow in any conventional manner. A plurality of pin assemblies 7 are secured to the mounting plate 5 and have fiber optic pins 9 which extend across the archer's line of sight so that the fiber optic pins 9 operate as the pins of the sight. Fiber optic pins are flexible and can be somewhat fragile. To protect the pins 9 from damage, a generally U-shaped guard 11 surrounds the pins 9. The guard 11 includes upper and lower legs 13 which extend from the mounting plate 5 in the plane of the pins 9. A plate or web 15 extends between the legs 13 in front of the pins 9. The guard 11 is secured to the mounting plate 5 using screws 17 which extend through the legs 13 into the top and bottom surfaces of the mounting plate. The guard 11 preferably is sufficiently wide so that the legs 13 and web 15 are wider than pin assemblies 7. The pins 9 will therefore be protected against damaged if the sight 1 is accidentally brushed against a bush, tree, etc.

Figure 2:
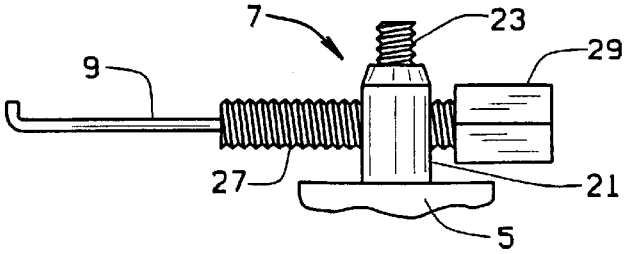
FIG. 2 is a side view of a mounting block in which a fiber optic pin or pin is mounted.
Figure 3:
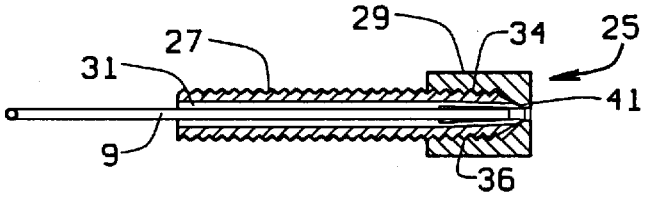
FIG. 3 is a cross-sectional view of a pin holder which receives the fiber optic pin.
Figure 4:
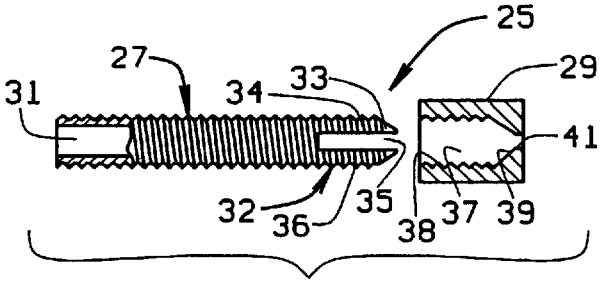
FIG. 4 is an exploded view of the holder, partly in cross-section.
Figure 5:
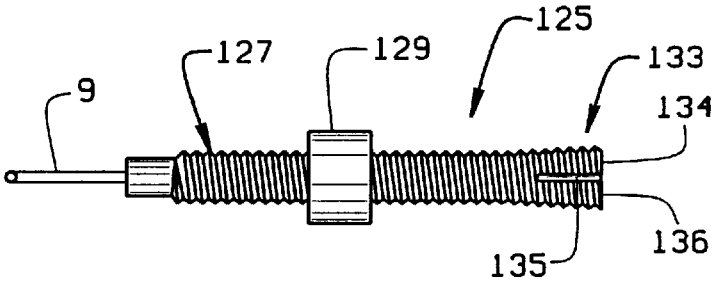
FIG. 5 is a side elevational view of an second embodiment of the pin holder.
Figure 6:
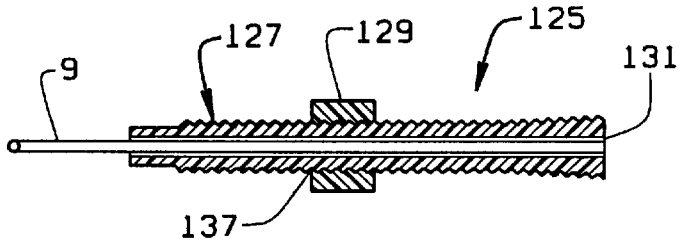
FIG. 6 is a cross-sectional view of the pin holder of FIG. 5 prior to clamping of the pin holder to the fiber optic pin.
Figure 7:
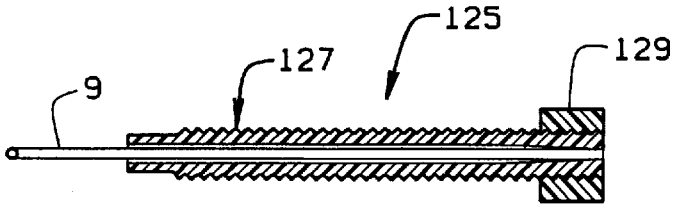
FIG. 7 is a cross-sectional view of the pin holder of FIG. 5 when in a clamping mode.

A pin assembly 7 is shown in more detail in FIGS. 2–4. The pin assemblies 7 are identical. Thus, only one pin assembly is described. The pin assembly 7 includes pin mounting blocks 21 which are secured to the mounting plate 5, for example, by screw 23, which extends through the mount. A pin holder 25 extends through the mounting block 21 to secure the pin 9 in the sight 1. The mounting block 21 has an internally threaded opening and the pin holder 25 has an externally threaded member. The holder 25 is thus secured into the mount 21.

The pin holder 25 includes an externally threaded shaft 27 and a compression nut 29. It is the shaft 27 that is screwed into the mount 21 to secure the holder 25 to the mount. The shaft 27 is hollow and defines a smooth bore 31 sized to receive the fiber optic pin 9. The bore 31 has a diameter slightly larger than the pin 9 so that the pin may be easily slid into the shaft 27. As will become clear, this makes assembly of the pin assembly 7 easy and allows for easy replacement of the pin, should replacement be necessary. The shaft 27 is chamfered or beveled as at 33, to make the back end 32 of the shaft slightly pointed. The shaft however does not come to a sharp point at its end. A slot 35 is also formed at the back end 32 of the shaft to define two spaced apart legs 34 and 36. The slot 35 extends forwardly from the end 32 of the shaft a distance sufficiently long to make the legs 34 and 36 slightly flexible. The legs 34 and 36 may thus be pushed together to reduce the diameter of the portion of the bore 31 which extends through the legs. This enables the legs to clamp down on the pin 9 without compressing the pin 9 to the point of potentially damaging the pin. The slot 35 preferably is about ¼" long, which is approximately 1.8 times the diameter of the shaft.

The compression nut 29 defines an internally threaded bore 37 which does not extend the full length of the nut 29. Rather, it extends form an opening 38 at the front surface of the nut to a point which is short of the back surface of the nut. A bore 41 of narrower diameter extends from the back surface of the nut to the bore 39. The bore 41 and the bore 39 are joined by a tapered section 39. The hole or bore 41, although smaller than the bore 31, is slightly larger in diameter than the back of 32 of shaft 27.

In use, the pin 9 is threaded into the shaft such that the pin extends at least through the back end of the shaft, and preferably extends out the back end of the shaft. A short portion of the fiber optic pin 9, at the front thereof, is turned 90° to extend toward the archer so that the archer can see the lighted tip of the pin 9 for improved sighting. Obviously, a portion of the pin 9 will extend out the front of the shaft to act as the pin of the sight. The nut is then screwed about the shaft 27 or the shaft is screwed into the nut, with the back end of the shaft being received in the nut. The opening 38 of the nut bore 37 is sized so that the back, tapered end 32 of the shaft will fit into the nut, however, the front end of the shaft will not. When the shaft 27 is threaded into the nut, the tapered end 32 of the shaft reaches the tapered portion 39 of the nut. Upon threaded the shaft further into the nut, the tapered end 32 of the shaft is forced through the tapered portion 39 of the nut. The slit 35 of the shaft allows the legs 34 and 36 of the shaft to come together, and the tip 33 of the shaft enters the hole or bore 41. When the tip of the shaft enters bore 41, the legs of the shaft come together, as just stated, and the threads at the end 32 of the shaft separate from the threads of the nut. Further, the inner surfaces of the legs 34 and 36 grip the pin 9. The grip of the legs on the pin secures the pin in holder 7, and hence sight 1, without damaging the pin. Hence the ability of the pin to transmit light is not affected.

The pin 9 can be inserted in the holder 25 before or after the shaft 27 has been screwed into the mount 21, and before or after the mount has been secured to the mounting block 5. As seen from FIG. 1, the holder 25 is inserted in mount 21 so that the nut 29 is outside of the guard 11 and that the front end of the shaft 27 extends into the area defined by the guard 11. If necessary, the pin 9 can be replaced simply by loosening the nut 29 on the shaft 27 an amount sufficient to loosen the grip of legs 34 and 36 on the pin. The pin 9 can then be removed and easily replaced with a new pin.

Figure 8:
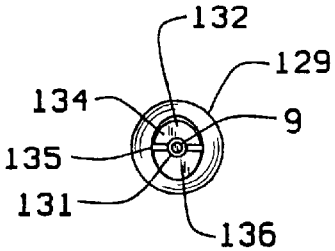
FIG. 8 is a rear elevational view of the pin holder.

An alternative embodiment of the pin holder is shown in FIGS. 5–8. The pin holder 125 includes an externally threaded shaft 127 and a compression nut 129. The shaft 127 is screwed into the mount 21 to secure the holder 125 to the mount in the same manner that holder 25 is screwed into the mount 21. The shaft 127 is hollow and defines a smooth bore 131 sized to receive the fiber optic pin 9. The bore 131 has a diameter slightly larger than the pin 9 so that the pin may be easily slid into the shaft 127. The bore 131 is preferably of generally constant diameter when the holder 127 is not clamped down on the pin 9. As will become clear, this makes assembly of the pin assembly 7 easy and allows for easy replacement of the pin, should replacement be necessary. The shaft 127 is of generally constant outer diameter. However, at its back end 133, the shaft expands outwardly. The shaft 127 expands outwardly only along one diameter of the shaft, so that the back end of the shaft is generally oval in shape, rather than circular, as seen in FIG. 8.

A slot 135 is also formed at the back end 133 of the shaft to define two spaced apart legs 134 and 136. The slot 135 extends forwardly from the end 132 of the shaft a distance sufficiently long to make the legs 134 and 136 slightly flexible. The legs 134 and 136 may thus be pushed together to reduce the diameter of the portion of the bore 131 which extends through the legs. This enables the legs to clamp down on the pin 9 without compressing the pin 9 to the point of potentially damaging the pin. The slot 135 preferably is about ¼" long, which is approximately 1.6–1.8 times the diameter of the shaft.

The length of the shaft 125 which expands corresponds generally to the length of the slot 135. Thus, the shaft 125 begins to expand at the closed en of the slot 135. The expansion or slope of the back end 133 of the shaft is preferable shallow or gentle expansion to enable the compression nut 129 to reach nearly to the end of the shaft 125 when the nut 125 is threaded over the expanding back end 133 of the shaft. Preferably, the slope of the expanding back end is about 5°–7°, for a shaft having an outer diameter of about 0.125"–0.141". The slope could be slightly more, or less, if desired.

The compression nut 129 defines an internally threaded bore 137 which has a generally constant diameter. The bore 137 is sized to be threaded on the constant-diameter section of the shaft 127, and has an inner diameter smaller than the diameter of the sloped end section 133 of the shaft 127.

In use, the pin 9 is threaded into the shaft 127 such that the pin extends at least through the back end of the shaft. A short portion of the fiber optic pin 9, at the front thereof, is turned 90° to extend toward the archer so that the archer can see the lighted tip of the pin 9 for improved sighting. Obviously, a portion of the pin 9 will extend out the front of the shaft to act as the pin of the sight. The nut 129 is then screwed about the shaft 127 or the shaft is screwed into the nut, from the forward end of the shaft until the nut 129 is threaded over the expanded section 133 of the shaft. As the nut 129 is threaded onto the shaft section 133, the legs 134 and 136 of the shaft to come together to tightly grip the fiber optic pin 9. The grip of the legs on the pin secures the pin in holder 125, and hence sight 1, without damaging the pin. Hence the ability of the pin to transmit light is not affected.

Unlike the pin holder 25 of FIGS. 3 and 4 which is made of metal, and preferably brass, the pin holder 125 of FIGS. 5–8 is made of plastic, and preferably of a clear plastic.

As variations within the scope of the appended claims may be apparent to those skilled in the art, the foregoing description is set forth only for illustrative purposes and is not meant to be limiting. For example, although the mount 21 is shown to be generally cylindrical, it could be a generally rectangular block, or any other desired shape. The mount 21 can be mounted to the mounting block 5 to be pivotal relative to the mounting block in the plane of the pins 9, or to be slidable axially along the mounting block, or combinations thereof. Rather than the nut having a short tapered section in the nut, the nut can have a tapered section that is the length of the shaft legs. This will keep the shaft threads in meshing contact with the nut threads over the length of the nut bore. Although the shaft 125 expands outwardly along only one diameter to have a generally oval shape at its back end, the shaft could expand about two perpendicular diameters to have a generally cone shaped end section having a circular end. These examples are merely illustrative.

I claim:

1. A fiber optic pin sight, for holding at least one fiber optic pin, the pin sight being mountable to an archery bow, the pin sight including:

a mounting plate which is operatively secured to a bow;

a plurality of pin mounting blocks secured to the mounting plate;

a fiber optic pin holder secured to each said mounting block; and said at least one fiber optic pin extending through and secured in each said pin holder, the pin holder gripping the fiber optic pin along a portion of the pin;

the fiber optic pin holder includes an externally threaded shaft defining a shaft bore and a nut defining a nut bore, said shaft having a length, said pin extending through said shaft bore, the shaft having a front end and a back end, the shaft having an outer diameter which is substantially constant along substantially the length of the shaft, the outer diameter being slopingly expanded along at least one diameter of the shaft at the back end of said shaft, said shaft further including a slot extending forwardly from said back end of said shaft to define two spaced apart legs, said slot being sufficiently long such that said legs are slightly flexible, wherein as said nut is threaded over said shaft, said nut is threaded over said expanded section of said shaft bringing said shaft legs together such that said legs tightly grip said fiber optic pin and resists its movement once adjusted and when subjected to extensive forces during usage of the archery bow, and threadedly turning said nut off of the expanded section of said shaft frees the pin for axial adjustment within the fiber optic pin holder.

2. The fiber optic pin sight of claim 1 wherein said pin holder shaft is threadedly secured in said pin mounting block.

3. The fiber optic pin sight of claim 1 wherein each said pin mounting block is threadedly secured to said mounting plate.

4. The fiber optic pin sight of claim 3 wherein said sight includes a guard surrounding said fiber optic pins to protect said fiber optic pins, said guard being generally U-shaped and including an upper leg extending from a top surface of said mounting plate, a lower leg extending from a lower surface of said mounting plate, and a web extending between said upper and lower legs; said guard being extended in alignment with said fiber optic pins and being sufficiently wide to protect said fiber optic pins.

5. A pin holder for holding at least one fiber optic pin in a fiber optic pin sight for an archery bow, said holder including:

a shaft, said shaft being at least partially threaded, said shaft defining a shaft bore, and a nut threadedly engaged upon said threaded shaft and defining a threaded nut bore;

said fiber optic pin extending through said shaft bore, said threaded shaft having a front end, a back end, and a length, a shaft body that is at least partially threaded, said shaft body being of substantially constant diameter, said shaft expanding outwardly along at least one diameter at said back end of said shaft, a slot extending inwardly from said back end of said shaft to define two spaced apart legs, said slot being sufficiently long such that said legs are slightly flexible; and the nut bore having a generally constant diameter, wherein said nut is threaded over said shaft legs, said nut compressing said shaft legs together such that said legs grip said fiber optic pin in retention, and wherein threadedly shifting said nut off of said shaft legs frees the fiber optic pin for axial adjustment within the shaft bore.

6. The pin holder of claim 5 wherein said slot of the shaft body has a length approximately 1.6–1.8 times the outer diameter of said shaft.

7. The pin holder of claim 5 wherein said shaft is made of plastic.

8. The pin holder of claim 7 wherein said plastic is translucent.

* * * * *